US008937552B1

(12) United States Patent
Williams

(10) Patent No.: US 8,937,552 B1
(45) Date of Patent: Jan. 20, 2015

(54) HEADS DOWN WARNING SYSTEM

(71) Applicant: The Boeing Company, Seal Beach, CA (US)

(72) Inventor: Jeffrey L. Williams, Parker, CO (US)

(73) Assignee: The Boeing Company, Chicago, IL (US)

( * ) Notice: Subject to any disclaimer, the term of this patent is extended or adjusted under 35 U.S.C. 154(b) by 99 days.

(21) Appl. No.: 13/732,671

(22) Filed: Jan. 2, 2013

(51) Int. Cl.
*G08B 23/00* (2006.01)
*G08B 21/18* (2006.01)

(52) U.S. Cl.
CPC ..... *G08B 21/18* (2013.01)
USPC ..... 340/573.1; 340/575; 340/576; 340/439; 348/77; 348/78; 348/135

(58) Field of Classification Search
USPC ..... 340/575, 576, 425.5, 439, 436; 348/148, 222.1, 77, 78, 135, 103; 701/36, 45, 1
See application file for complete search history.

(56) References Cited

U.S. PATENT DOCUMENTS 5,729,619 A * 3/1998 Puma ..... 382/115
6,496,117 B2 * 12/2002 Gutta et al. ..... 340/576
7,762,665 B2 7/2010 Vertegaal et al.
7,889,244 B2 * 2/2011 Tsukizawa et al. ..... 348/222.1
8,292,433 B2 10/2012 Vertegaal
8,538,044 B2 * 9/2013 Tsukizawa et al. ..... 381/117
2002/0140562 A1 * 10/2002 Gutta et al. ..... 340/576
2004/0150514 A1 * 8/2004 Newman et al. ..... 340/435
2004/0239509 A1 * 12/2004 Kisacanin et al. ..... 340/575
2006/0287779 A1 * 12/2006 Smith et al. ..... 701/1
2008/0060497 A1 * 3/2008 Lambert et al. ..... 84/307
2009/0022368 A1 * 1/2009 Matsuoka et al. ..... 382/103
2009/0243880 A1 * 10/2009 Kiuchi ..... 340/903
2009/0273687 A1 * 11/2009 Tsukizawa et al. ..... 348/222.1
2010/0007479 A1 * 1/2010 Smith ..... 340/436
2010/0253526 A1 * 10/2010 Szczerba et al. ..... 340/576
2011/0043617 A1 2/2011 Vertegaal et al.
2011/0169625 A1 * 7/2011 James et al. ..... 340/439
2011/0199202 A1 * 8/2011 De Mers et al. ..... 340/439
2011/0249868 A1 * 10/2011 Tsukizawa et al. ..... 382/103
2011/0279676 A1 * 11/2011 Terada et al. ..... 348/148
2012/0083974 A1 * 4/2012 Sandblom ..... 701/45
2012/0169503 A1 * 7/2012 Wu et al. ..... 340/575
2012/0242819 A1 * 9/2012 Schamp ..... 348/78
2012/0268367 A1 10/2012 Vertegaal et al.
2012/0300061 A1 * 11/2012 Osman et al. ..... 348/135
2013/0009761 A1 * 1/2013 Horseman ..... 340/425.5
2013/0162791 A1 * 6/2013 Chen et al. ..... 348/77
2013/0245886 A1 * 9/2013 Fung et al. ..... 701/36
2014/0043459 A1 * 2/2014 Tsukizawa et al. ..... 348/78
2014/0098232 A1 * 4/2014 Koike ..... 348/148
2014/0132407 A1 * 5/2014 Kumai et al. ..... 340/439
2014/0139655 A1 * 5/2014 Mimar ..... 348/77

* cited by examiner

*Primary Examiner* — Hoi Lau
(74) *Attorney, Agent, or Firm* — Armstrong Teasdale LLP

(57) ABSTRACT

An environment associated with at least one crew member is identified, and a line-of-sight associated with the at least one crew member is determined. An alarm is generated when the line-of-sight remains within a predetermined area for an elapsed time that exceeds a first predetermined temporal threshold associated with the identified environment.

14 Claims, 3 Drawing Sheets

HEADS DOWN WARNING SYSTEM

BACKGROUND

The present disclosure relates generally to crew management systems and, more particularly, to a heads down warning system that maybe used in managing crew resources.

At least some known vehicles include devices that provide information to a user of the vehicle. While the information provided by at least some known devices may be helpful to the user, the user's attention may be diverted away from another task (e.g., watching where the vehicle is headed). Fixation and/or preoccupation with a touchscreen device, for example, may cause the user to neglect the outside environment, resulting in an increase in accidents or other user error. Additionally, the user may not have access to at least some potentially useful information when fixated and/or preoccupied with steering the vehicle without referring to and/or looking at flight instrumentation for extended periods of time.

BRIEF SUMMARY

In one aspect, a method is provided for use in managing crew resources. The method includes identifying an environment associated with at least one crew member. A line-of-sight associated with the at least one crew member is determined, and an alarm is generated when the line-of-sight remains within a predetermined area for an elapsed time that exceeds a first predetermined temporal threshold associated with the identified environment.

In another aspect, a computing system is provided for use in managing crew resources. The computing system includes a processor, and a computer-readable storage device having encoded thereon computer readable instructions that are executable by the processor to perform functions including identifying an environment associated with at least one crew member, determining a line-of-sight associated with the at least one crew member, and generating an alarm when the line-of-sight remains within a predetermined area for an elapsed time that exceeds a first predetermined temporal threshold associated with the identified environment.

In yet another aspect, a system is provided for use in managing crew resources. The system includes a sensor configured to detect at least one of an eye position of at least one crew member and a head position of the at least one crew member. A computing system includes a processor, and a computer-readable storage device having encoded thereon computer readable instructions that are executable by the processor to perform functions including identifying an environment associated with the at least one crew member, determining a line-of-sight associated with the at least one crew member based on at least one of the eye position and the head position, and generating an alarm when the line-of-sight remains within a predetermined area for an elapsed time that exceeds a first predetermined temporal threshold associated with the identified environment.

The features, functions, and advantages described herein may be achieved independently in various implementations of the present disclosure or may be combined in yet other implementations, further details of which may be seen with reference to the following description and drawings.

Although specific features of various implementations may be shown in some drawings and not in others, this is for convenience only. Any feature of any drawing may be referenced and/or claimed in combination with any feature of any other drawing.

DETAILED DESCRIPTION

The present disclosure relates generally to crew management systems and, more particularly, to a heads down warning system for use in managing crew resources In one implementation, an eye position and/or a head position of a crew member is used to determine a line-of-sight associated with the crew member. An alarm, alert, or notification is generated when the line-of-sight remains within a predetermined area for an elapsed time that exceeds a first predetermined temporal threshold associated with a particular environment or application. Implementations of the methods and systems described herein enable a computing system to (i) identify an environment associated with at least one crew member, (ii) determine a line-of-sight associated with the at least one crew member, and (iii) generate an alarm when the line-of-sight remains within a predetermined area for an elapsed time that exceeds a first predetermined temporal threshold associated with the identified environment.

The methods and systems described herein may be implemented using computer programming or engineering techniques including computer software, firmware, hardware or any combination or subset thereof, wherein the technical effects may include at least one of: a) identifying an environment associated with at least one crew member, b) detecting an eye position of the at least one crew member, c) detecting a head position of the at least one crew member, d) determining a line-of-sight associated with the at least one crew member, e) generating an alarm when the line-of-sight remains within a predetermined area for an elapsed time that exceeds a first predetermined temporal threshold associated with the identified environment, f) generating an alarm when the line-of-sight is outside of a predetermined area for an elapsed time that exceeds a second predetermined temporal threshold associated with the identified environment, g) receiving a plurality of input signals from a user input device, and h) generating an alarm when a quantity associated with the plurality of input signals is greater than a predetermined threshold associated with the identified environment.

As used herein, an element or step recited in the singular and proceeded with the word "a" or "an" should be understood as not excluding plural elements or steps unless such exclusion is explicitly recited. Moreover, references to "some implementations" or "one implementation" are not intended to be interpreted as excluding the existence of additional implementations that also incorporate the recited features.

Figure 1:
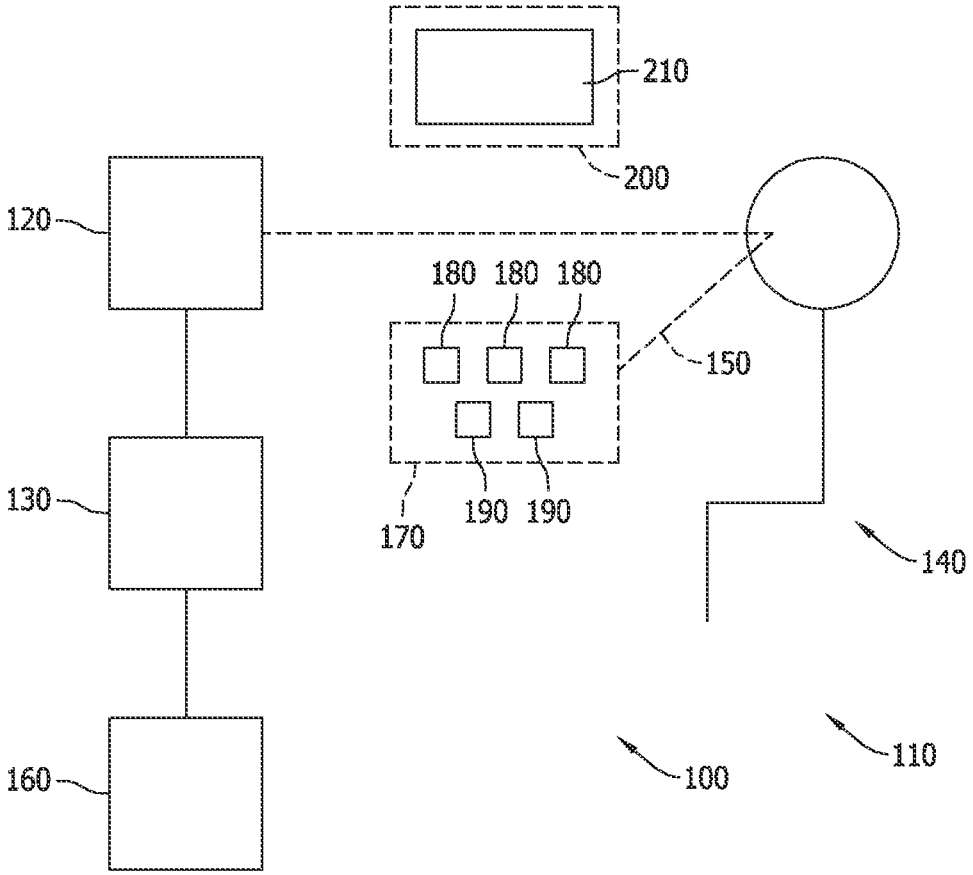
FIG. 1 is a schematic illustration of an example crew management system 100.

FIG. 1 is a schematic illustration of an example crew management system 100 for use with a cockpit 110. Although the implementations described herein are used in an aviation and/or aeronautical context, crew management system 100 may be used within other industries such as, but not limited to, the automotive and/or nautical industries. In some implementations, crew management system 100 includes at least one sensor 120 and a computing device 130 coupled to sensor 120. In some implementations, computing device 130 is programmed to identify an environment associated with at least one crew member 140 within cockpit 110. As used herein, the term "environment" refers to the setting or conditions in which a particular activity is performed by crew member 140. The environment may be a product of a phase of flight, an altitude, traffic, and other performance-related criteria. For example, in some implementations, the environment may be identified as being a taxiing environment, a takeoff environment, an enroute environment, or a final approach environment. Alternatively, in other implementations, the environment may be any setting or condition that enables crew management system 100 to function as described herein.

In some implementations, sensor 120 is configured to detect or track an eye position or movement of crew member 140 and/or a head position or movement of crew member 140. As used herein, the term "eye position" refers to a position of the pupil with respect to the eye socket, and the term "eye movement" refers to a movement of the pupil within the eye socket from a first eye position to a second eye position. As used herein, the term "head position" refers to a position of the head with respect to a space, such as a cockpit, and the term "head movement" refers to a movement of the head within the cockpit from a first head position to a second head position. Accordingly, it should be understood that, in at least some implementations, the eye and the head are independently moveable.

In some implementations, sensor 120 is configured to transmit at least one sensor signal associated with the detected eye position and/or head position to computing device 130. In some implementations, computing device 130 determines a line-of-sight 150 associated with crew member 140 based on the eye position and/or the head position of crew member 140. As used herein, the term "line-of-sight" refers to a direction that crew member 140 is looking.

In some implementations, computing device 130 is programmed to transmit at least one alarm signal to an alarm generator 160 that is configured to provide feedback or stimuli to crew member 140 when line-of-sight 150 remains within a predetermined first area 170 for an elapsed time that exceeds a first predetermined temporal threshold associated with the environment. In at least some implementations, computing device 130 determines and/or re-determines the first temporal threshold based on a phase of flight, an altitude, traffic, and other performance-related criteria. For example, in at least some implementations, the first predetermined temporal threshold is approximately 10 seconds in a taxiing environment, and the first predetermined temporal threshold is approximately 60 seconds in an enroute environment. In at least some implementations, alarm generator 160 is a speaker configured to provide audial stimuli, and/or a light configured to provide visual stimuli. Alternatively, in other implementations, alarm generator 160 may provide stimuli using any mechanism that enables crew management system 100 to function as described herein.

In some implementations, at least one flight instrument 180 is positioned within first area 170. For example, in at least some implementations, flight instruments 180 include, without limitation, an altimeter, an attitude indicator, an airspeed indicator, a course deviation indicator, a heading indicator, a magnetic compass, a radio magnetic indicator, and/or a vertical speed indicator. Alternatively, in other implementations, any device may be positioned within first area 170 that enables crew management system 100 to function as described herein. For example, in at least some implementations, a user input device 190 is positioned within first area 170. User input device 190 is configured to receive user input from crew member 140 and transmit at least one input signal associated with the user input to computing device 130.

In at least some implementations, alarm generator 160 provides feedback or stimuli to crew member 140 when a quantity associated with the input signals (e.g., a number of touches) exceeds a predetermined threshold associated with the identified environment. In at least some implementations, computing device 130 determines and/or re-determines the threshold based on a phase of flight, an altitude, traffic, and other performance-related criteria. For example, in at least some implementations, the predetermined threshold is approximately five touches while line-of-sight 150 remains within first area 170 in a taxiing environment, the predetermined threshold is approximately ten touches while line-of-sight 150 remains within first area 170 in an enroute environment, and the predetermined threshold is approximately three touches while line-of-sight 150 remains within first area 170 in a final approach environment.

In at least some implementations, alarm generator 160 provides feedback or stimuli to crew member 140 when line-of-sight 150 is outside of a predetermined second area 200 for an elapsed time that exceeds a second predetermined temporal threshold associated with the environment. In at least some implementations, computing device 130 determines and/or re-determines the second temporal threshold based on a phase of flight, an altitude, traffic, and other performance-related criteria. For example, in at least some implementations, the second predetermined temporal threshold is approximately fifteen seconds in a taxiing environment, and the second predetermined temporal threshold is approximately seventy-five seconds in an enroute environment. In at least some implementations, a windshield 210 is positioned within second area 200. Windshield 210 is substantially transparent to enable crew member 140 to look therethrough to navigate the aircraft. Alternatively, in other implementations, any device may be positioned within second area 200 that enables crew management system 100 to function as described herein.

In at least some implementations, computing device 130 determines a line-of-sight 150 associated with each of a plurality of crew members 140 within cockpit 110. For example, in at least some implementations, a first line-of-sight 150 associated with a first crew member 140 is determined based on an eye position and/or a head position of the first crew member 140, and a second line-of-sight 150 associated with a second crew member 140 is determined based on an eye position and/or a head position of the second crew member 140. In at least some implementations, alarm generator 160 provides feedback or stimuli to at least one crew member 140 when each of the lines-of-sight 150 are within first area 170 for an elapsed time that exceeds the first predetermined temporal threshold associated with the environment. For example, in at least some implementations, alarm generator 160 provides feedback or stimuli to at least one crew member 140 when both the first line-of-sight 150 and the second line-of-sight 150 are within first area 170 for longer than approximately ten seconds in a taxiing environment or longer than approximately sixty seconds in an enroute environment.

In at least some implementations, alarm generator 160 provides feedback or stimuli to at least one crew member 140 when each of the lines-of-sight 150 is outside second area 200 for an elapsed time that exceeds the second predetermined temporal threshold associated with the environment. For example, in at least some implementations, alarm generator 160 provides feedback or stimuli to at least one crew member 140 when both the first line-of-sight 150 and the second line-of-sight 150 are outside second area 200 for longer than approximately fifteen seconds in a taxiing environment or longer than approximately seventy-five seconds in an enroute environment.

Figure 2:
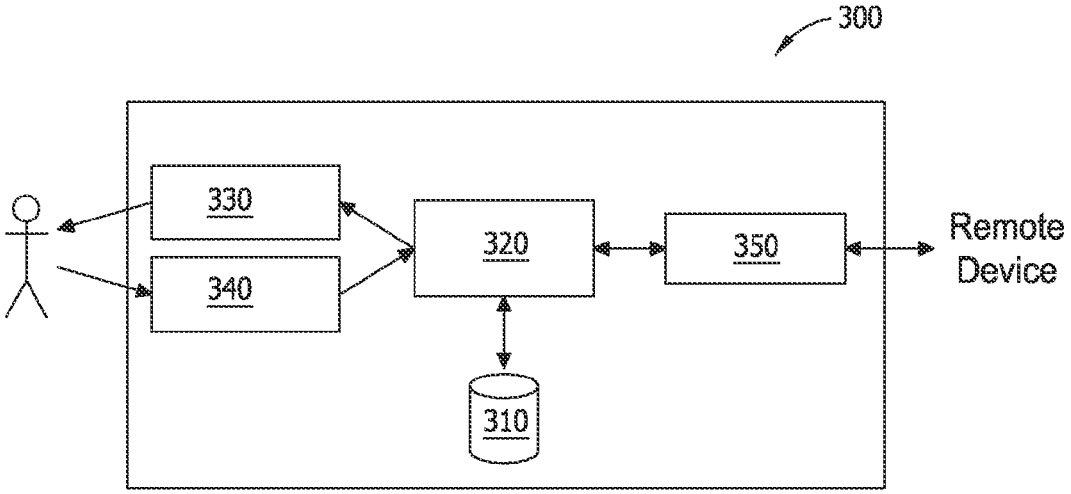
FIG. 2 is a schematic illustration of an example computing system that may be used with the crew management system shown in FIG. 1.

FIG. 2 is a schematic illustration of an example computing system 300 that may be used with and/or within crew management system 100, sensor 120, alarm generator 160, flight instrument 180, and/or user input device 190. In some implementations, computing system 300 includes a memory device 310 and a processor 320 coupled to memory device 310 for use in executing instructions. More specifically, in at least some implementations, computing system 300 is configurable to perform one or more operations described herein by programming memory device 310 and/or processor 320. For example, processor 320 may be programmed by encoding an operation as one or more executable instructions and by providing the executable instructions in memory device 310.

Processor 320 may include one or more processing units (e.g., in a multi-core configuration). As used herein, the term "processor" is not limited to integrated circuits referred to in the art as a computer, but rather broadly refers to a controller, a microcontroller, a microcomputer, a programmable logic controller (PLC), an application specific integrated circuit, and other programmable circuits.

In some implementations, memory device 310 includes one or more devices (not shown) that enable information such as executable instructions and/or other data to be selectively stored and retrieved. In some implementations, such data may include, but is not limited to, biometric data, operational data, and/or control algorithms. Alternatively, computing system 300 may be configured to use any algorithm and/or method that enable the methods and systems to function as described herein. Memory device 310 may also include one or more computer readable media, such as, without limitation, dynamic random access memory (DRAM), static random access memory (SRAM), a solid state disk, and/or a hard disk.

In some implementations, computing system 300 includes a presentation interface 330 that is coupled to processor 320 for use in presenting information to a user. For example, presentation interface 330 may include a display adapter (not shown) that may couple to a display device (not shown), such as, without limitation, a cathode ray tube (CRT), a liquid crystal display (LCD), a light-emitting diode (LED) display, an organic LED (OLED) display, an "electronic ink" display, and/or a printer. In some implementations, presentation interface 330 includes one or more display devices.

Computing system 300, in some implementations, includes an input interface 340 for receiving input from the user. For example, in some implementations, input interface 340 receives information suitable for use with the methods described herein. Input interface 340 is coupled to processor 320 and may include, for example, a joystick, a keyboard, a pointing device, a mouse, a stylus, a touch sensitive panel (e.g., a touch pad or a touch screen), and/or a position detector. It should be noted that a single component, for example, a touch screen, may function as both presentation interface 330 and as input interface 340.

In some implementations, computing system 300 includes a communication interface 350 that is coupled to processor 320. In some implementations, communication interface 350 communicates with at least one remote device, such as sensor 120, alarm generator 160, flight instrument 180, and/or user input device 190. For example, communication interface 350 may use, without limitation, a wired network adapter, a wireless network adapter, and/or a mobile telecommunications adapter. A network (not shown) used to couple computing system 300 to the remote device may include, without limitation, the Internet, a local area network (LAN), a wide area network (WAN), a wireless LAN (WLAN), a mesh network, and/or a virtual private network (VPN) or other suitable communication means.

Figure 3:
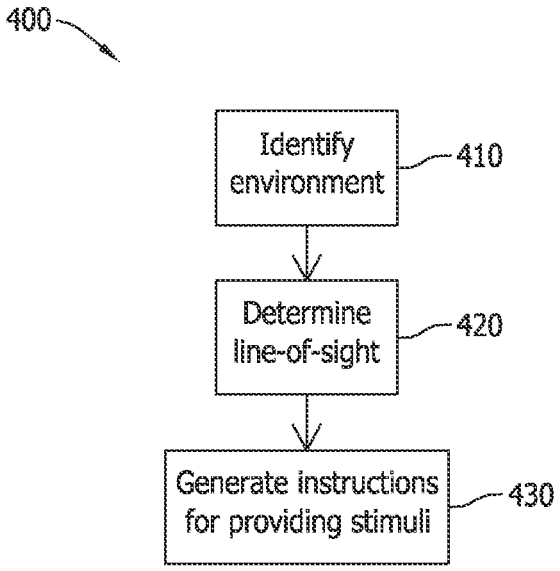
FIG. 3 is a flowchart of an example method that may be implemented by the computing system shown in FIG. 2.

FIG. 3 is a flowchart of an example method 400 that may be implemented to manage crew resources. During operation, in some implementations, an environment associated with a crew member 140 is identified 410. In one implementation, computing device 130, based on a predefined rule set, automatically identifies 410 the environment based on input received from at least one sensor 120, flight instrument 180, and/or user input device 190. In some implementations, a line-of-sight 150 associated with crew member 140 is determined 420. In one implementation, computing device 130, based on a predefined rule set, automatically determines 420 line-of-sight 150 based on input received from at least one sensor 120.

In some implementations, computing device 130, based on a predefined rule set, generates 430 instructions for providing feedback or stimuli to crew member 140 and transmits the instructions to alarm generator 160. For example, in at least some implementations, computing device 130 transmits the instructions when line-of-sight 150 remains within a first area 170 for an elapsed time that exceeds a first predetermined temporal threshold associated with the identified environment. Additionally or alternatively, computing device 130 may transmit the instructions when a quantity associated with input signals received from user input device 190 is greater than a predetermined threshold associated with the identified environment and/or when line-of-sight 150 is outside of a second area 200 for an elapsed time that exceeds a second predetermined temporal threshold associated with the identified environment.

The implementations described herein relate generally to crew managements systems and, more particularly, to a heads down warning system for use in managing crew resources. The implementations described herein monitors an amount of time a crew member looks at, or looks away from, a predetermined location, and notifies the crew member when the amount of time deviates from a predetermined threshold. Accordingly, the implementations described herein may be used to reduce an amount of time spent looking at a display screen and/or an amount of time not looking through a windshield. Moreover, the implementations described herein may be used to remind crew members to scan primary instrumentation.

Exemplary implementations of methods and systems for managing crew resources are described above in detail. The methods and systems are not limited to the specific implementations described herein, but rather, components of systems and/or steps of the method may be utilized independently and separately from other components and/or steps described herein. Each method step and each component may also be used in combination with other method steps and/or components. Although specific features of various implementations may be shown in some drawings and not in others, this is for convenience only. Any feature of a drawing may be referenced and/or claimed in combination with any feature of any other drawing.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for managing crew resources, the method implemented using a computing device coupled to a memory device, the method comprising:

identifying an environment associated with at least one crew member;

determining a first line-of-sight associated with a first crew member of the at least one crew member;

determining a second line-of-sight associated with a second crew member of the at least one crew member; and generating an alarm when both the first line-of-sight and the second line-of-sight are within a predetermined area for an elapsed time that exceeds a first predetermined temporal threshold associated with the identified environment.

2. A method in accordance with claim 1, wherein determining a line-of-sight further comprises detecting an eye position of the at least one crew member.

3. A method in accordance with claim 1, wherein determining a line-of-sight further comprises detecting a head position of the at least one crew member.

4. A method in accordance with claim 1 further comprising receiving a plurality of input signals from a user input device, wherein generating an alarm further comprises generating the alarm when a quantity associated with the plurality of input signals is greater than a predetermined threshold associated with the identified environment.

5. A method in accordance with claim 1, wherein generating an alarm further comprises generating the alarm when the line-of-sight is outside of a predetermined area for an elapsed time that exceeds a second predetermined temporal threshold associated with the identified environment.

6. A computing system for managing crew resources, said computing system comprising:

a processor; and a computer-readable storage device having encoded thereon computer readable instructions that are executable by the processor to perform functions comprising:

identifying an environment associated with at least one crew member;

determining a first line-of-sight associated with a first crew member of the at least one crew member;

determining a second line-of-sight associated with a second crew member of the at least one crew member; and generating an alarm when both the first line-of-sight and the second line-of-sight are within a predetermined area for an elapsed time that exceeds a first predetermined temporal threshold associated with the identified environment.

7. A computing system in accordance with claim 6, wherein the functions performed by the processor further comprise detecting an eye position of the at least one crew member.

8. A computing system in accordance with claim 6, wherein the functions performed by the processor further comprise detecting a head position of the at least one crew member.

9. A computing system in accordance with claim 6, wherein the functions performed by the processor further comprise receiving a plurality of input signals from a user input device, wherein the alarm is generated when a quantity associated with the plurality of input signals is greater than a predetermined threshold associated with the identified environment.

10. A computing system in accordance with claim 6, wherein the functions performed by the processor further comprise generating the alarm when the line-of-sight is outside of a predetermined area for an elapsed time that exceeds a second predetermined temporal threshold associated with the identified environment.

11. A system for managing crew resources, said system comprising:

a sensor configured to detect at least one of an eye position and a head position of at least one of a first crew member and a second crew member; and a computing system comprising a processor, and a computer-readable storage device having encoded thereon computer readable instructions that are executable by the processor to perform functions comprising:

identifying an environment associated with the at least one crew member;

determining a first line-of-sight associated with the first crew member based on at least one of the eye position and the head position of the first crew member;

determining a second line-of-sight associated with the second crew member based on at least one of the eye position and the head position of the second crew member; and generating an alarm when both the first line-of-sight and the second line-of-sight are within a predetermined area for an elapsed time that exceeds a first predetermined temporal threshold associated with the identified environment.

12. A system in accordance with claim 11 further comprising a user input device configured to transmit a plurality of input signals, wherein the alarm is generated when a quantity associated with the plurality of input signals is greater than a predetermined threshold associated with the identified environment.

13. A system in accordance with claim 11, wherein the functions performed by the processor further comprise generating the alarm when the line-of-sight is outside of a predetermined area for an elapsed time that exceeds a second predetermined temporal threshold associated with the identified environment.

14. A system in accordance with claim 11 further comprising a flight instrument positioned within the predetermined area, wherein the flight instrument includes at least one of an altimeter, an attitude indicator, an airspeed indicator, a course deviation indicator, a heading indicator, a magnetic compass, a radio magnetic indicator, and a vertical speed indicator.

* * * * *